US006761430B2

(12) United States Patent
Kinoshita

(10) Patent No.: US 6,761,430 B2
(45) Date of Patent: Jul. 13, 2004

(54) INKJET PRINTING APPARATUS AND PRELIMINARY DISCHARGE CONTROL METHOD

(75) Inventor: Yoshiyuki Kinoshita, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/985,533

(22) Filed: Nov. 5, 2001

(65) Prior Publication Data

US 2002/0054185 A1 May 9, 2002

(30) Foreign Application Priority Data

Nov. 7, 2000 (JP) ..... 2000-339352

(51) Int. Cl.[7] ..... B41J 2/165
(52) U.S. Cl. ..... 347/35; 347/36; 347/104
(58) Field of Search ..... 347/35, 36, 92, 347/22–24, 29–34

(56) References Cited

U.S. PATENT DOCUMENTS 4,888,602 A * 12/1989 Watanabe et al. ..... 346/134
5,610,641 A * 3/1997 Ikado ..... 347/33
6,457,803 B1 10/2002 Ohkoda

* cited by examiner

*Primary Examiner*—Stephen D. Meier
*Assistant Examiner*—Ly T Tran
(74) *Attorney, Agent, or Firm*—Fitzpatrick, Cella, Harper & Scinto

(57) ABSTRACT

A printing apparatus and preliminary discharge control method capable of minimizing the influence of a preliminary discharge operation on printing and keeping a short printing time are disclosed. In an inkjet printing apparatus for printing image data on a printing medium by discharging ink from a printhead mounted on a carriage which scans back and forth parallel to the printing medium, an ink receptor having at least the same length as the scanning range of the printhead is formed below a printing position at which the printhead prints image data on a printing medium. When this inkjet printing apparatus is to perform preliminary discharge, an edge of a printing medium is sensed during the forward and backward scans of the carriage, and the carriage mounting the printhead is moved to be separated a predetermined distance from the sensed edge of the printing medium. At this position separated by the predetermined distance, the printhead is controlled to perform a preliminary discharge operation.

23 Claims, 10 Drawing Sheets

INKJET PRINTING APPARATUS AND PRELIMINARY DISCHARGE CONTROL METHOD

FIELD OF THE INVENTION

The present invention relates to an inkjet printing apparatus and a preliminary discharge control method.

BACKGROUND OF THE INVENTION

An inkjet printer forms an image by discharging an ink droplet from a discharge orifice formed in a printhead and sticking the discharged ink droplet onto a printing sheet.

A printhead usually has a plurality of discharge orifices. If a discharge orifice not frequently used is present in these discharge orifices during printing, the ink viscosity in this discharge orifice rises owing to water evaporation to clog this discharge orifice. To avoid this phenomenon, ink droplets corresponding to a predetermined number of dots are discharged, at predetermined time intervals or in accordance with the calculated use ratios of the ink discharge orifices, while printing is executed, into an ink receptor (to be referred to as a preliminary discharge receptor) formed outside the scanning region of the printhead, thereby holding the state of each discharge orifice and its vicinity constant. This operation is called a preliminary discharge operation.

FIG. 7 is a perspective view showing an outline of the arrangement of a conventional inkjet printer.

Referring to FIG. 7, reference numeral 101 denotes a printing sheet; 102, an automatic sheet feeding mechanism which feeds stacked printing sheets one by one into the printer and, as printing progresses, discharges each printing sheet forward (in the direction of an arrow); 103, a carriage; and 104, an ink cartridge containing a printhead which is so mounted as to discharge ink downward (toward the printing sheet).

The carriage 103 on which the ink cartridge 104 is mounted moves back and forth parallel to the printing sheet in a direction perpendicular to the conveyance direction of the printing sheet. An image is formed by discharging ink stored in the ink cartridge 104 toward the printing sheet.

Reference numeral 105 denotes a carriage motor; and 106, a driving belt. The carriage 103 is interlocked with the carriage motor 105 by the driving belt 106. When the carriage motor 105 is driven forward and backward, the carriage 103 moves forward and backward. Guide shafts 107 and 108 for mounting the carriage 103 support the forward and backward movements of the carriage 103 mounting the ink cartridge 104.

Reference numerals 109 and 110 denote preliminary discharge receptors. In a preliminary discharge operation, the carriage 103 moves to a position above the preliminary discharge receptor 109 or 110, and the printhead discharges ink droplets corresponding to a predetermined number of dots.

In this conventional inkjet printer, as can be seen from FIG. 7, a preliminary discharge receptor is generally formed on one or both sides of the scanning region of the printhead. When a preliminary discharge operation is to be executed, the printhead is moved from the printing end position to the position above the preliminary discharge receptor.

FIG. 8 is a schematic view showing the control of a printing operation and a preliminary discharge operation in this conventional inkjet printer.

As shown in FIG. 8, when an image such as "A . . . A" is to be printed on the printing sheet 101, the carriage 103 mounting the printhead explained in FIG. 7 scans within the range of a line 301 from a point x to a point y. This line 301 is made up of a printing region in which an image is formed by discharging ink onto the printing sheet, and acceleration (deceleration) regions a and b. To form an image in the printing region, the carriage 103 must be driven at a constant speed. When the carriage 103 is at rest at a point 302, this carriage 103 is accelerated in the region a to move at the constant speed from a point 303. Also, to stop the carriage 103, which has moved at the constant speed to a point 304, at a point 305, this carriage 103 is decelerated in the region b.

When the image is to be printed by moving the carriage 103 in the opposite direction from the point y to the point x, the region b is an acceleration region, and the region a is a deceleration region. Therefore, printing region+region a+region b is the carriage moving range corresponding to a printing operation of one scan.

On the other hand, when a preliminary discharge operation is to be executed, the carriage 103 is moved to the position above the preliminary discharge receptor 109 or 110 to discharge ink. That is, when preliminary discharge is to be performed for the preliminary discharge receptor 109, the carriage 103 is moved to a point 307. A region d indicates a moving region from the carriage stop position to the preliminary discharge receptor 109. When preliminary discharge is to be performed for the preliminary discharge receptor 110, the carriage 103 is moved to a point 306. A region c indicates a moving region from the carriage stop position to the preliminary discharge receptor 110.

In the above prior art, however, if the width of the printing sheet is smaller than the maximum width of the scanning region, the actual scanning region of the printhead narrows in accordance with the width of the printing sheet. This increases the moving distance from the end of the scanning region to the preliminary discharge receptor when a preliminary discharge operation is to be performed. This undesirably prolongs the printing execution time.

FIG. 9 is a schematic view showing the control of a printing operation and a preliminary discharge operation of the conventional inkjet printer, when the width of a printing sheet is much smaller than the scan enable region. As is apparent from the comparison of FIGS. 8 and 9, the width of a printing sheet 400 is much smaller than the scan enable region shown in FIG. 8.

When an image such as "A . . . A" is to be printed on this printing sheet 400, the scanning range of the carriage 103 mounting the printhead explained in FIG. 7 is the range indicated by a line 401 from a point x' to a point y'. This line 401 is made up of a printing region in which an image is formed by discharging ink onto the printing sheet, and acceleration (deceleration) regions a' and b'. To form an image in the printing region, the carriage 103 must be moved at a constant speed. When the carriage 103 is at rest at a point 402, this carriage 103 is accelerated in the region a' to move at the constant speed from a point 403. Also, to stop the carriage 103, which has moved at the constant speed to a point 404, at a point 405, this carriage 103 is decelerated in the region b'.

When the image is to be printed by moving the carriage 103 in the opposite direction from the point y' to the point x', the region b' is an acceleration region, and the region a' is a deceleration region. Therefore, printing region+region a'+region b' is the carriage moving range corresponding to a printing operation of one scan.

When a preliminary discharge operation is to be executed, the carriage 103 is moved to the position above the preliminary discharge receptor 109 or 110 to discharge ink. That is, when preliminary discharge is to be performed for the preliminary discharge receptor 109, the carriage 103 is moved to a point 407. A region d' indicates a moving region from the carriage stop position to the preliminary discharge receptor 109. When preliminary discharge is to be performed for the preliminary discharge receptor 110, the carriage 103 is moved to a point 406. A region c' indicates a moving region from the carriage stop position to the preliminary discharge receptor 110.

As can be seen by comparing FIGS. 8 and 9, the width of the printing region decreases because the width of the printing sheet decreases. However, since the position of the preliminary discharge receptor 109 remains unchanged, the region d' shown in FIG. 9 which is the moving region, from the carriage stop position to the preliminary discharge receptor 109, for performing a preliminary discharge operation is longer than the region d shown in FIG. 8. Therefore, although the printing region is narrowed, the carriage moving distance necessary to execute a preliminary discharge operation during a printing operation increases. This requires an extra time whenever a preliminary discharge operation is performed, prolonging the time to the completion of the printing operation.

SUMMARY OF THE INVENTION

Accordingly, it is an object of the present invention to provide a printing apparatus and preliminary discharge control method capable of minimizing the influence of a preliminary discharge operation on printing and keeping a short printing time.

According to one aspect of the present invention, the foregoing object is attained by providing an inkjet printing apparatus for printing on a printing medium by discharging ink, on the basis of printing data, from a printhead mounted on a carriage which moves back and forth on the printing medium. The apparatus includes preliminary discharge control means and preliminary discharge position designating means. The preliminary discharge control means controls the printhead to perform preliminary discharge, by which no printing is performed, between scanning actions of the carriage. The preliminary discharge position designating means designates a position at which the preliminary discharge is controlled by the preliminary discharge control means to be performed by the printhead. The preliminary discharge position designating means variably designates a preliminary discharge position, which is a predetermined distance away from an edge of the printing medium, as the position at which the preliminary discharge is to be performed, in accordance with a position of the edge of the printing medium.

The printing is desirably performed by forward and backward scans of the printhead.

The apparatus can further comprise an ink receptor for receiving ink discharged by preliminary discharge by the preliminary discharge control means, the ink receptor having a length not less than the length of a scanning range of the printhead. Alternatively, the apparatus can further comprise a plurality of ink receptors for receiving ink discharged by preliminary discharge by the preliminary discharge control means, in accordance with the width of the printing medium in the scanning direction.

The apparatus desirably further comprises sensing means for sensing an edge of the printing medium.

The preliminary discharge position designating means can designate a preliminary discharge position such that preliminary discharge is performed in a position separated a predetermined distance from the position of an edge of the printing medium, regardless of this edge position of the printing medium. The designated predetermined distance when the ink discharge frequency of the printing is relatively high is desirably made longer than that when the ink discharge frequency is relatively low.

When performing preliminary discharge after printing in a forward or backward scanning direction, the preliminary discharge control means desirably so controls the printhead as to move in the forward or backward scanning direction, after the printing is completed, and to perform a preliminary discharge operation.

The preliminary discharge position designating means can designate a preliminary discharge position in accordance with information about an edge of the printing medium sensed by the sensing means after the printing is performed.

The apparatus desirably further comprises storage means which, when preliminary discharge is to be performed after the printhead prints in a first direction of the forward and backward scans of the printhead, stores information about an edge of the printing medium sensed by the sensing means after the printing is completed, and, when preliminary discharge is to be performed after the printhead prints in a second direction opposite to the first direction, stores information about an edge of the printing medium sensed by the sensing means after the printing is completed.

The preliminary discharge control can be so performed that the preliminary discharge is performed, while the printhead is scanning, in a position farther from the printing medium than the position designated by the preliminary discharge position designating means, or that the preliminary discharge is performed before or after the scanning directions are switched.

Preferably, the printhead is an inkjet printhead for discharging ink by using thermal energy, and comprises an electrothermal converter for generating thermal energy to be applied to ink.

According to another aspect of the present invention, the foregoing object is attained by providing a preliminary discharge control method of an inkjet printing apparatus for printing on a printing medium by discharging ink, on the basis of printing data, from a printhead mounted on a carriage which moves back and forth on the printing medium. The method includes a preliminary discharge position designation step of designating a position at which preliminary discharge, by which no printing is performed, is performed between scanning actions of the carriage and a preliminary discharge control step of controlling the printhead to perform the preliminary discharge. The preliminary discharge position designation step variably designates a preliminary discharge position, which is a predetermined distance away from an edge of the printing medium, as the position at which the preliminary discharge is to be performed, in accordance with the position of the edge of the printing medium.

In accordance with the present invention as described above, when an inkjet printing apparatus for printing on a printing medium by discharging ink, on the basis of printing data, from a printhead mounted on a carriage which moves back and forth on the printing medium is to perform preliminary discharge, a position at which preliminary discharge, by which no printing is performed, is performed between scanning actions of the carriage is designated in accordance with the position of an edge of the printing medium in the scanning direction, and the printhead is caused to perform the preliminary discharge.

The invention is particularly advantageous since preliminary discharge can be performed in a designated position regardless of the width of a printing medium.

Accordingly, even when the width of a printing medium is smaller than the maximum width of a carriage scanning region, preliminary discharge can be performed with a minimum necessary carriage movement, without moving the carriage to an edge of the carriage scanning region unlike in conventional apparatuses. This can minimize the time for the carriage movement and therefore minimize the printing execution time.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, "print" not only represents the formation of significant information such as characters and graphics, but also broadly represents the formation of images, figures, patterns, and the like on a printing medium, or the processing of the medium, regardless of whether they are significant or insignificant and whether they are so visualized as to be visually perceivable by humans.

Also, a "printing medium" not only represents a paper sheet used in common printing apparatuses, but also broadly represents materials, such as cloth, a plastic film, a metal plate, glass, ceramics, wood, and leather, capable of accepting ink.

Furthermore, "ink" (to be also referred to as a "liquid" hereinafter) should be extensively interpreted similarly to the definition of "print" described above. That is, "ink" represents a liquid which, when applied onto a printing medium, can form images, figures, patterns, and the like, can process the printing medium, and can process ink (e.g., can solidify or insolubilize a coloring agent contained in ink applied to the printing medium).

Figure 1:
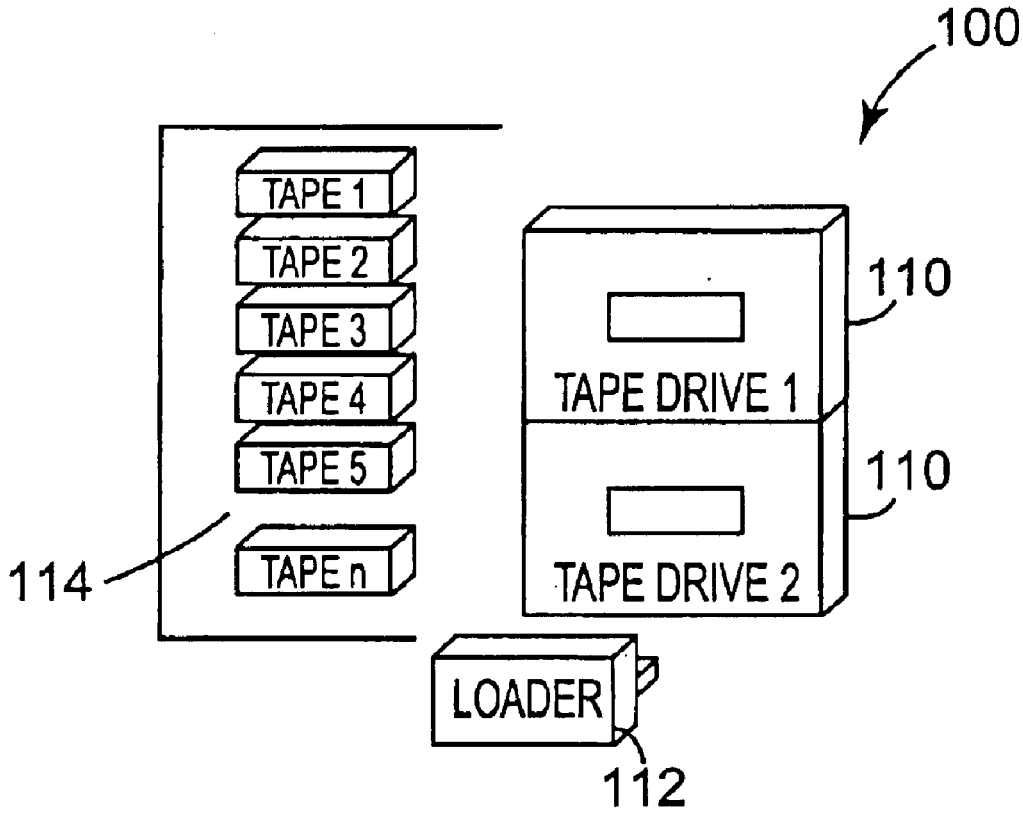
FIG. 1 is a perspective view showing an outline of the arrangement of an inkjet printer as a representative embodiment of the present invention.

FIG. 1 is a perspective view showing an outline of the arrangement of an inkjet printer as a representative embodiment of the present invention. The same reference numerals as in FIG. 7 of the prior art denote the same components in FIG. 1, and a detailed description thereof will be omitted. That is, only the characteristic elements of this embodiment will be explained.

In FIG. 1, reference numerals 109*a* and 110*a* denote preliminary discharge receptors having the same width as a scan enable region. These preliminary discharge receptors are open in an entire portion below a printing sheet shown in FIG. 1. That is, the preliminary discharge receptors 109*a* and 110*a* actually communicate with each other.

In a preliminary discharge operation (a discharge operation for maintaining a printhead without performing printing) of this embodiment, therefore, after a carriage 103 mounting a printhead 104 passes by an edge of a printing sheet 101, ink droplets corresponding to a predetermined number of dots are discharged into the preliminary discharge receptor 109*a* or 110*a* in a portion where the printing sheet 101 does not exist.

Figure 2:
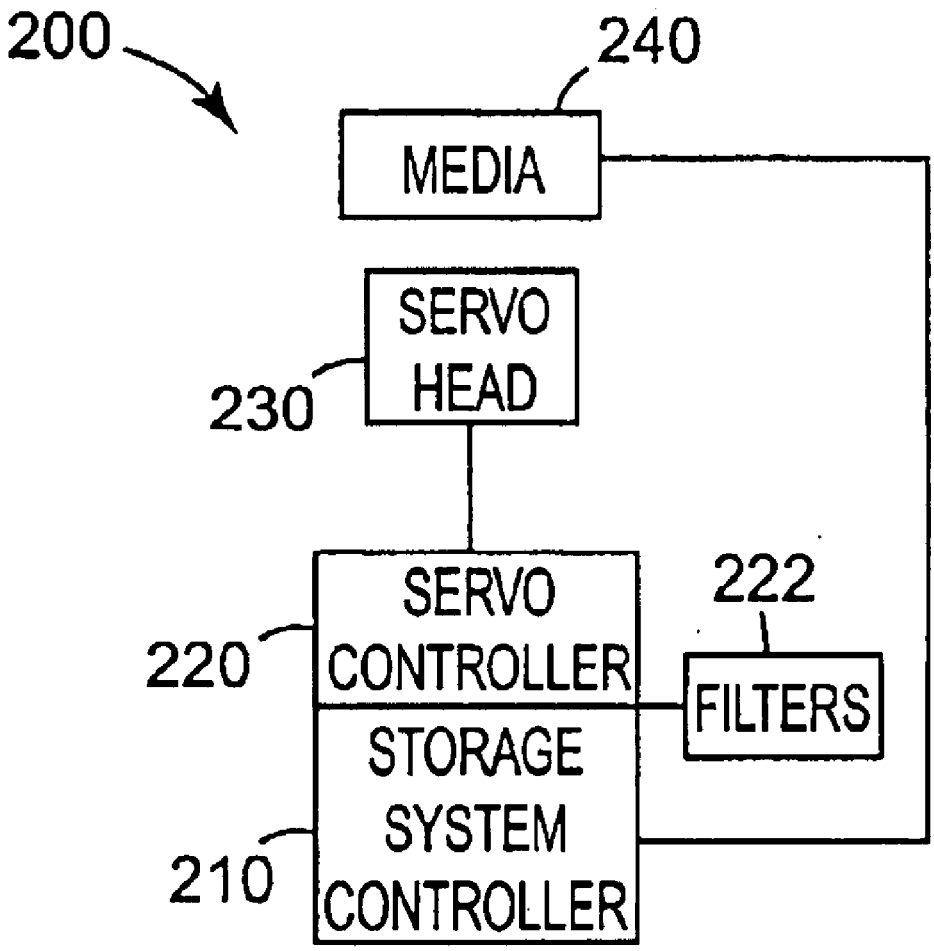
FIG. 2 is a side sectional view in which a printhead and its vicinity of the inkjet printer explained in FIG. 1 is cut in the conveyance direction of a printing sheet.

FIG. 2 is a side sectional view of the inkjet printer of FIG. 1 in the vicinity of the printhead taken along the conveyance direction of a printing sheet.

Figure 7:
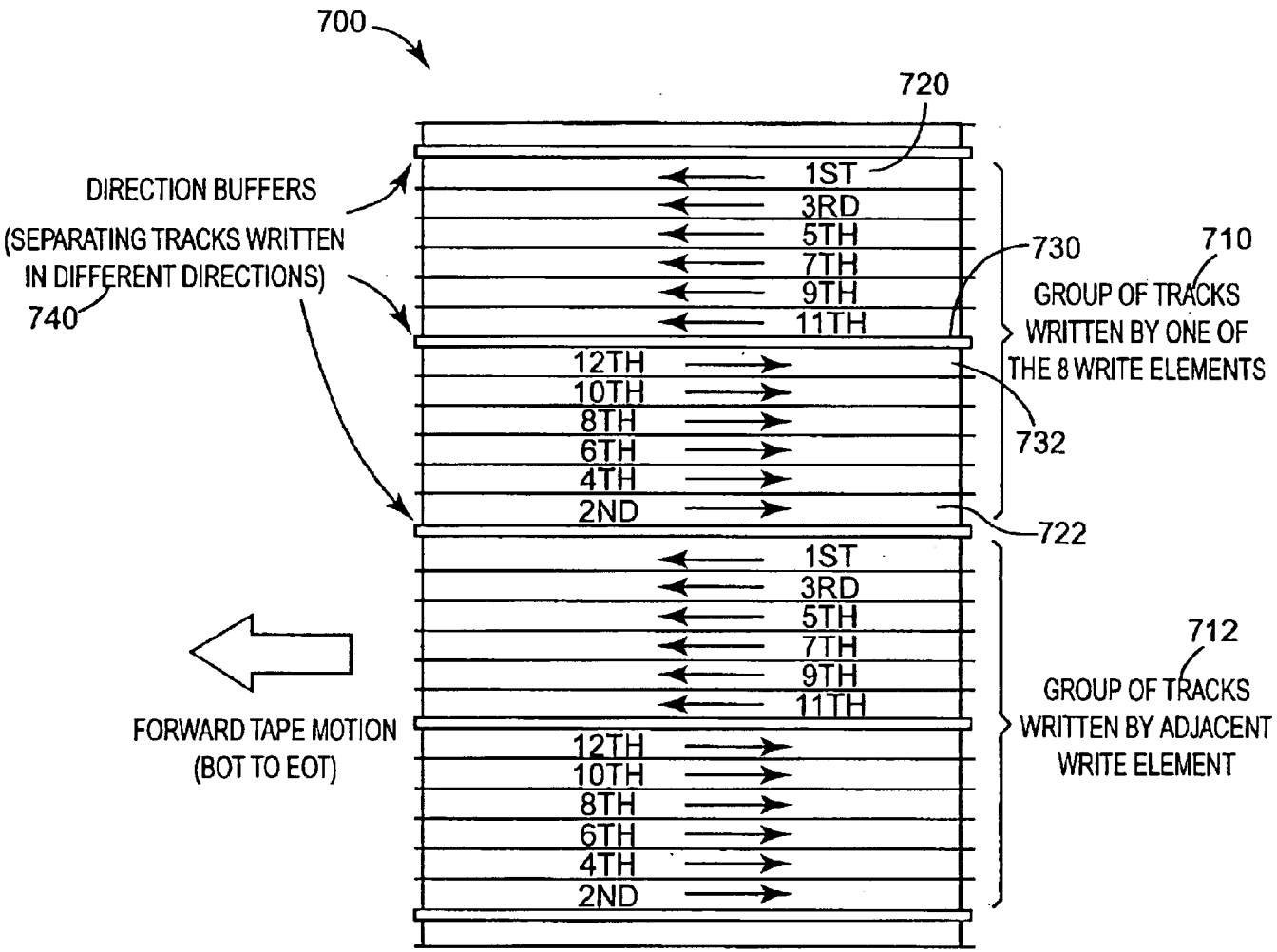
FIG. 7 is a perspective view showing an outline of the arrangement of a conventional inkjet printer.
Figure 8:
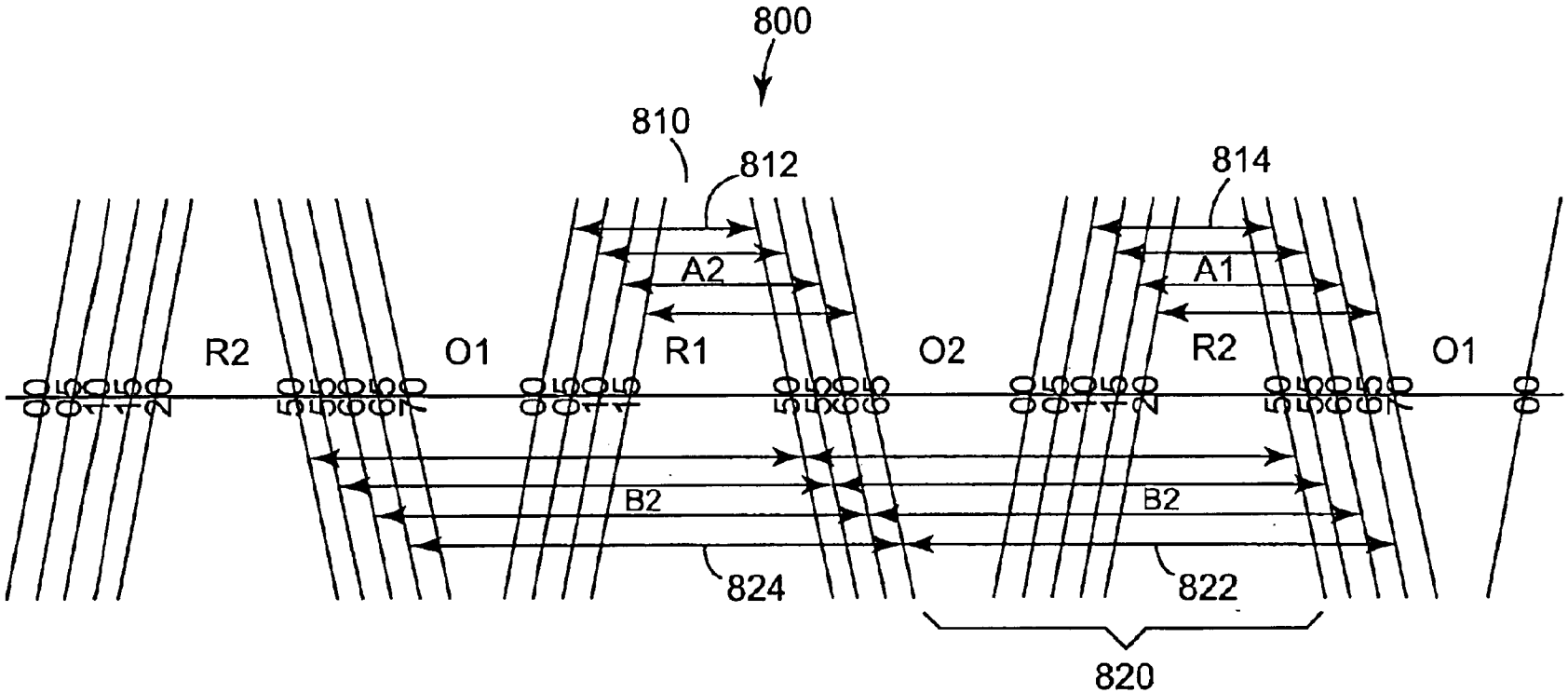
FIG. 8 is a schematic view showing the control of a printing operation and a preliminary discharge operation in the conventional inkjet printer.

In FIG. 2, the same reference numerals as in FIGS. 1 and 7 denote the same parts. As shown in FIG. 2, an image is formed on the printing sheet 101 by discharging ink, stored in an ink cartridge 104 mounted on the carriage 103, downward from a printhead 104N attached to the lower portion of this ink cartridge 104. Referring to FIG. 2, the carriage 103 moves back and forth, into and out from the paper, and the printing sheet 101 moves in the direction of an arrow as printing progresses.

Also, a sheet sensor 111 is attached to the carriage 103 and moves parallel to the printing sheet 101 along with the movement of the carriage 103. While moving like this, the sheet sensor 111 senses a position where the printing sheet is present and a position where it is absent, thereby sensing a point at which the sheet present state changes to the sheet absent state (or vice versa), as a printing sheet edge. This sheet sensor 111 is, e.g., an optical sensor, and can find the presence of a printing sheet by irradiating it with light and sensing the reflected light. This sensor can also be an interruptive sensor having a pair of a light emitting portion and a light receiving portion arranged to sandwich a printing sheet.

A control configuration for executing printing control of the above apparatus will be described below.

Figure 3:
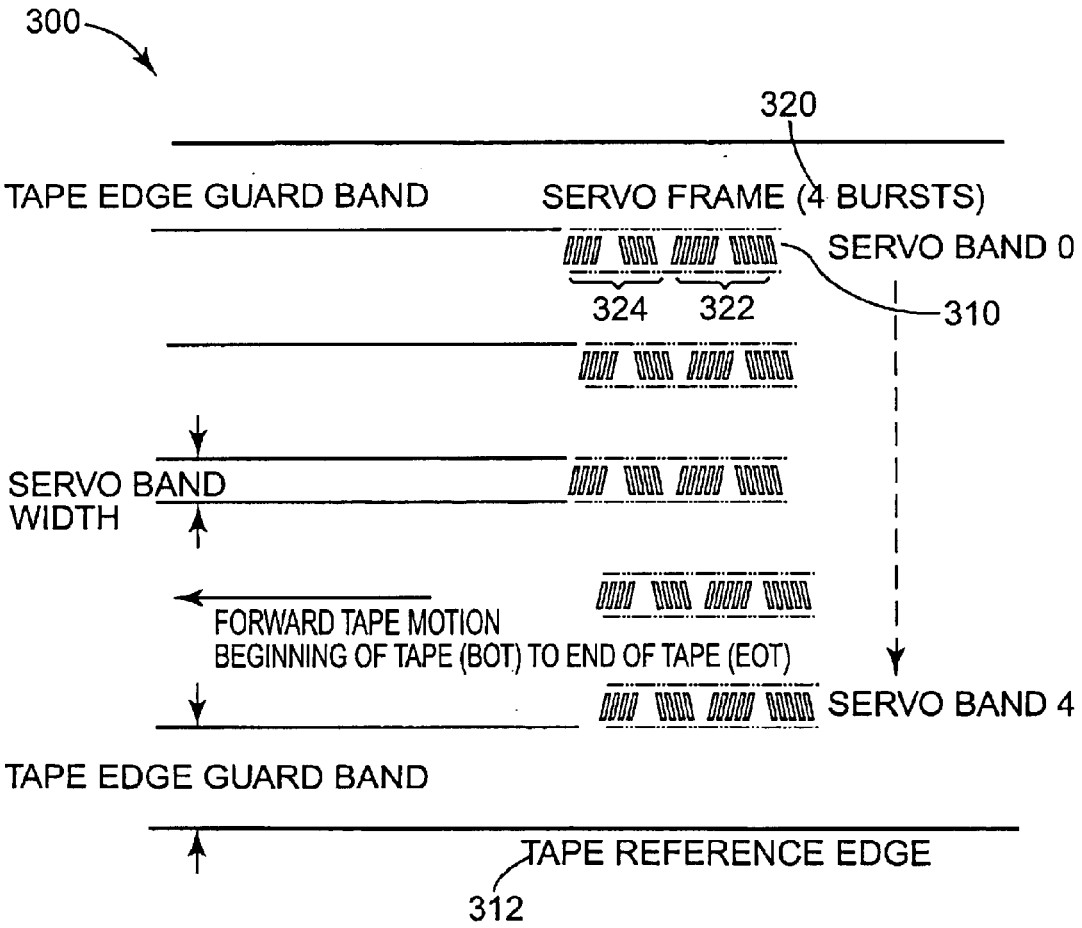
FIG. 3 is a block diagram showing the configuration of a control circuit of the inkjet printer.

FIG. 3 is a block diagram showing the configuration of a control circuit of the inkjet printer. In this FIG. 3 showing the control circuit, reference numeral 1700 denotes an interface for inputting a printing signal; 1701, an MPU; 1702, a ROM for storing control programs executed by the MPU 1701; 1703, a DRAM for saving various data (e.g., the printing signal and printing data supplied to the printhead 104N); and 1704, a gate array (G.A.) for controlling the supply of printing data to the printhead 104N. This gate array 1704 also controls data transfer between the interface 1700, the MPU 1701, and the RAM 1703.

Reference numeral 105 denotes a carriage motor for conveying the printhead 104N; 1709, a conveyor motor for conveying printing sheets; 1705, a head driver for driving the printhead 104N; and 1706 and 1707, motor drivers for driving the conveyor motor 1709 and the carriage motor 105, respectively.

The operation of the above control configuration will be explained below. A printing signal is input to the interface 1700 and converted into printing data between the gate array 1704 and the MPU 1701. The motor driver 1706 and 1707 are driven, and the printhead 104N is driven in accordance with the printing data supplied to the head driver 1705, thereby printing the data.

The DRAM 1703 stores data indicating the coordinates of the two ends, in the carriage scanning direction, of a printing sheet sensed by the sheet sensor 111. This data is used in carriage movement control during preliminary discharge to be described later.

Figure 4:
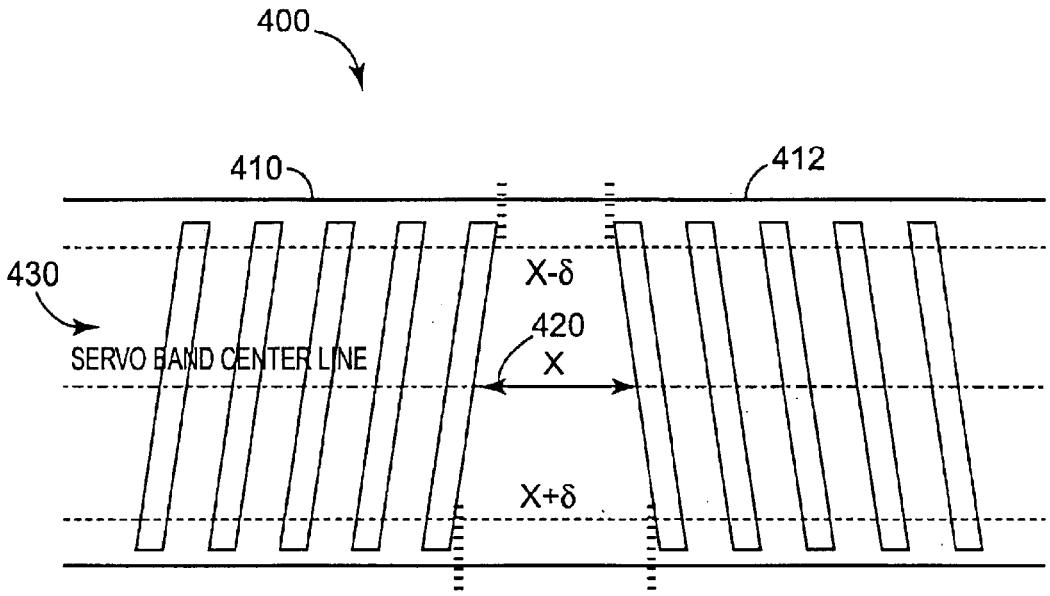
FIG. 4 is a schematic view showing the control of a printing operation and a preliminary discharge operation in the inkjet printer shown in FIG. 1, when the width of a printing sheet is much smaller than a scan enable region.

FIG. 4 is a schematic view showing the control of a printing operation and a preliminary discharge operation in the inkjet printer shown in FIG. 1, when the width of a printing sheet is much smaller than a scan enable region. As shown in FIG. 4, the width of a printing sheet 100 is much smaller than a maximum scan enable region (SMAX).

When an image such as "A . . . A" is to be printed on this printing sheet 100, the carriage 103 mounting the printhead explained in FIGS. 1 and 2 prints the image by moving back and forth within the range of a line 501 from a point x" to a point y". This line 501 is made up of a printing region in which an image is formed by discharging ink onto the printing sheet, and acceleration (deceleration) regions a" and b".

To form an image in the printing region, the carriage 103 must be driven at a constant speed. When the carriage 103 is at rest at a point 502 in FIG. 4, this carriage 103 is accelerated in the region a" to move at the constant speed from a point 503. Also, to stop the carriage 103, which has moved at the constant speed to a point 504, from the point 504, this carriage 103 is decelerated to a point 505 in the region b". When the image is printed by moving the carriage 103 from the point y" to the point x", the region b" is an acceleration region, and the region a" is a deceleration region.

Accordingly, printing region+region a"+region b" is the carriage moving range corresponding to a printing operation of one scan.

When a preliminary discharge operation is to be executed, the carriage 103 is moved to the position above the preliminary discharge receptor 109*a* (110*a*) having the width covering the whole maximum scan enable region, and ink is discharged.

When preliminary discharge is to be performed at the right-hand edge of the printing sheet 100 in FIG. 4, the carriage 103 is moved to a point 506. Since the preliminary discharge receptor 109*a* (110*a*) covers the entire scanning region of the carriage 103, a preliminary discharge operation is possible provided that the ink discharge orifices of the printhead 104N are outside the edge of the printing sheet. However, a preliminary discharge operation must be performed in a position separated from the printing sheet to a certain extent, so that ink discharged during the operation does not stick to the printing sheet. For this reason, a preliminary discharge operation is executed by moving the carriage 103 to the point 506. A region c" indicates a moving region from the carriage stop position (point 502) to the designated preliminary discharge position (point 506).

When preliminary discharge is to be performed at the left-hand edge of the printing sheet 100 in FIG. 4, the carriage 103 is moved to a point 507. Similar to the preliminary discharge performed at the right-hand edge of the printing sheet, a preliminary discharge operation must be performed in a position separated from the printing sheet to a certain extent, so the carriage 103 is moved to the point 507. A region d" indicates a moving region from the carriage stop position (point 505) to the designated preliminary discharge position (point 507).

Figure 9:
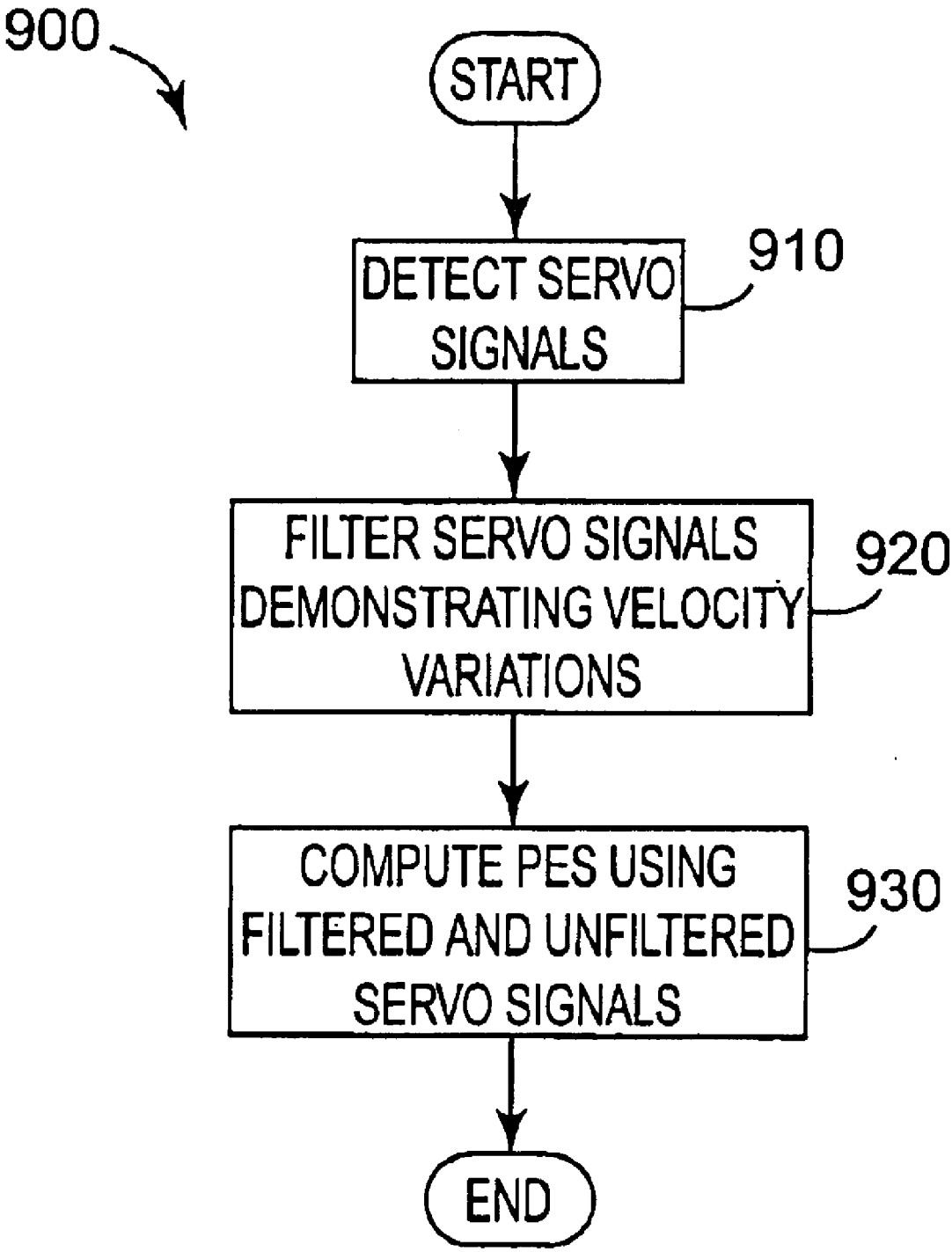
FIG. 9 is a schematic view showing the control of a printing operation and a preliminary discharge operation in the conventional inkjet printer, when the width of a printing sheet is much smaller than a scan enable region.
Figure 10:
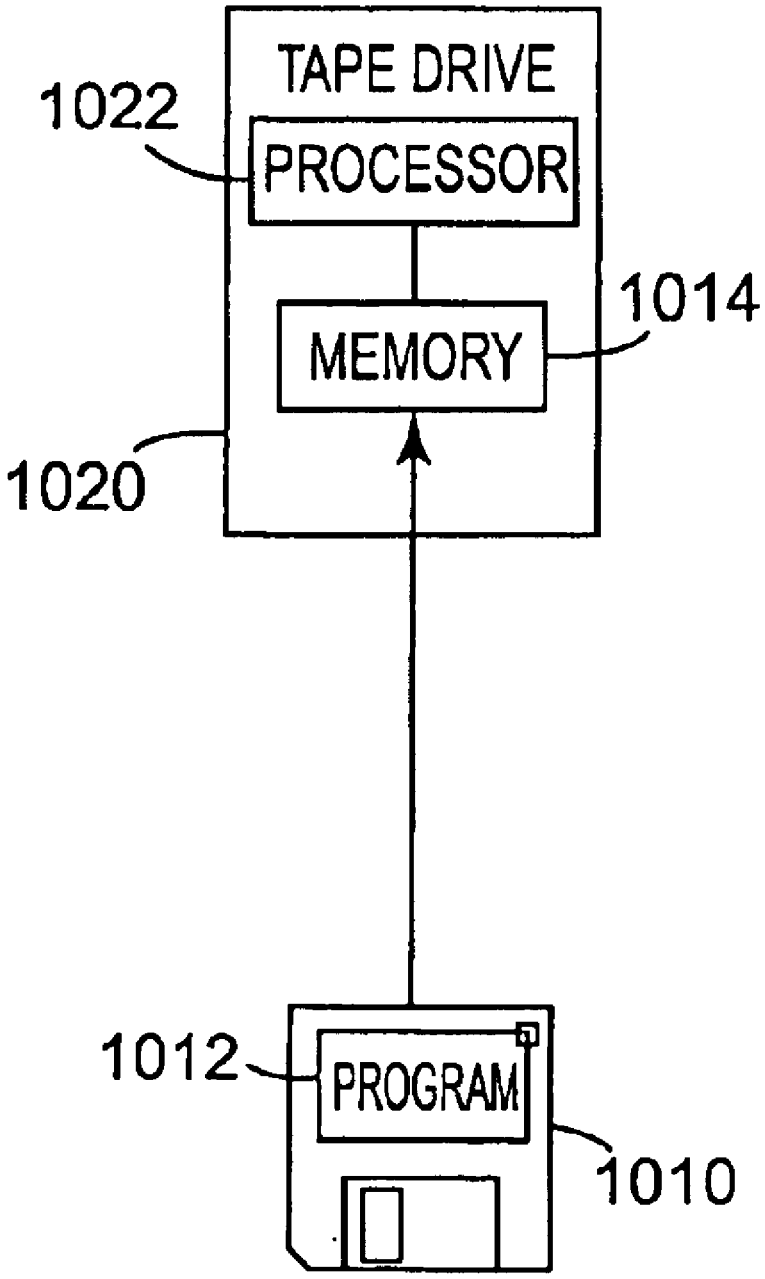
Figure 1:
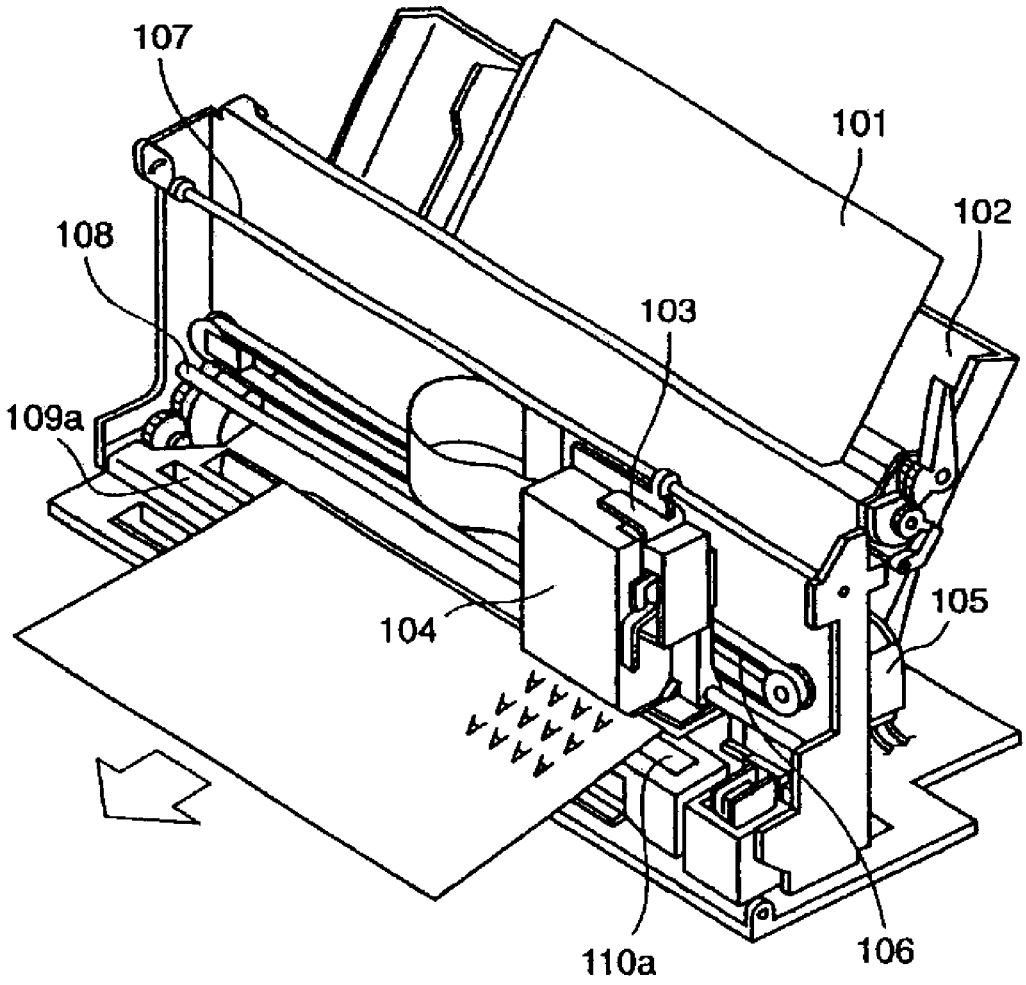
Figure 2:
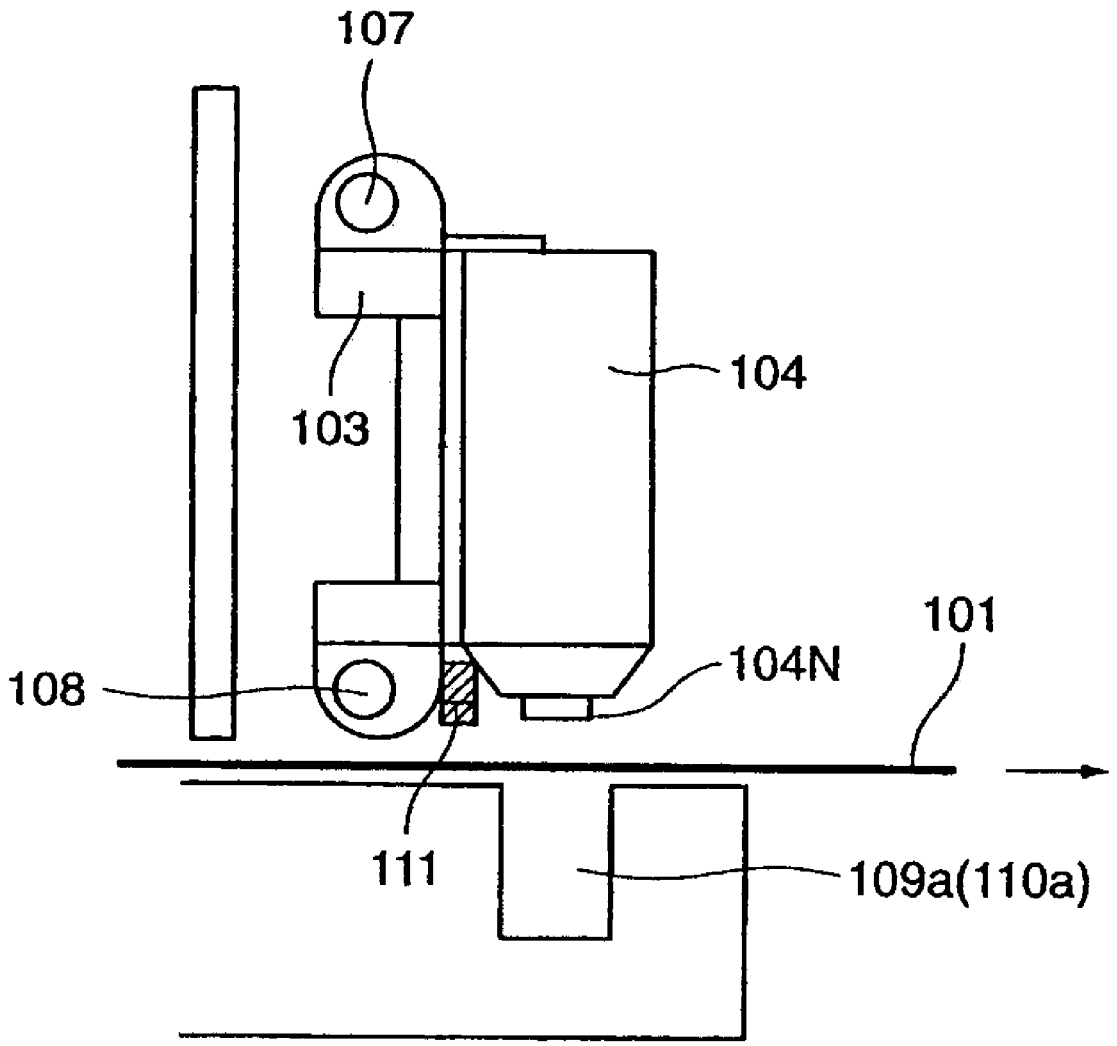
Figure 3:
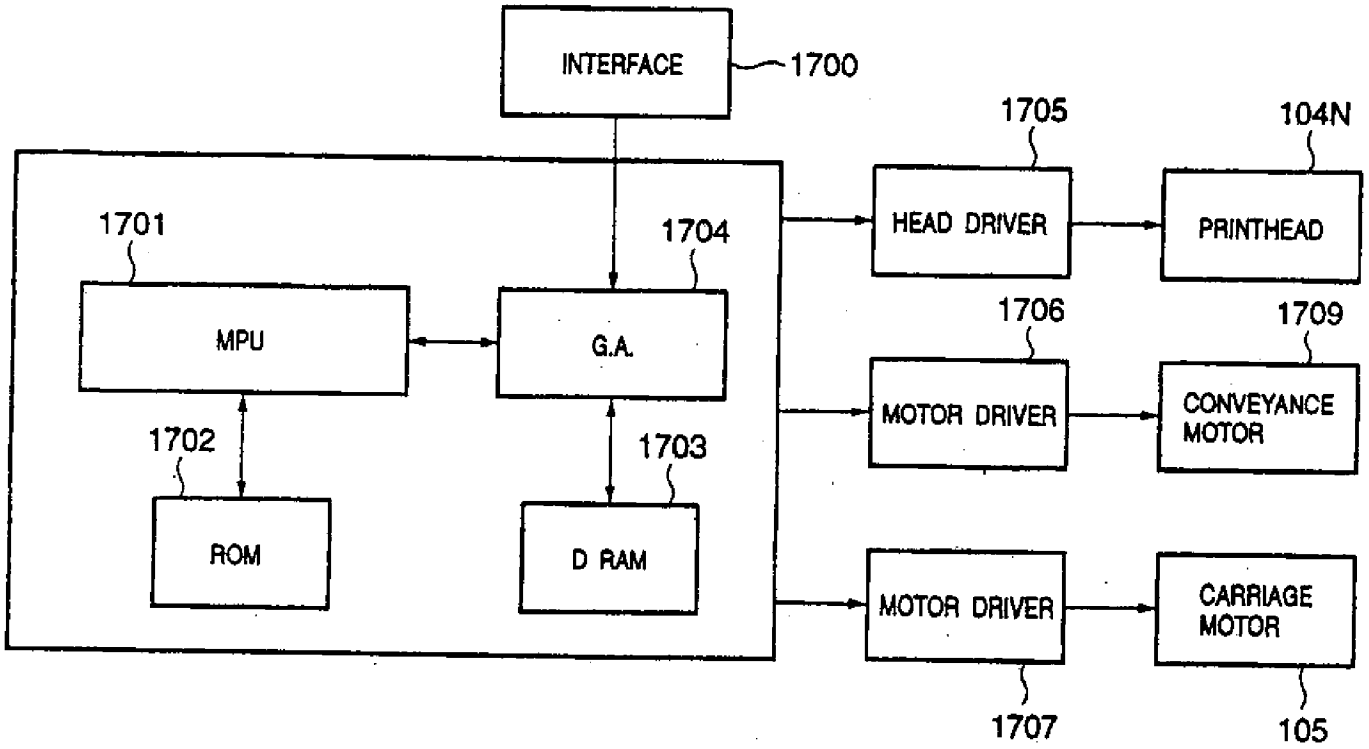
Figure 4:
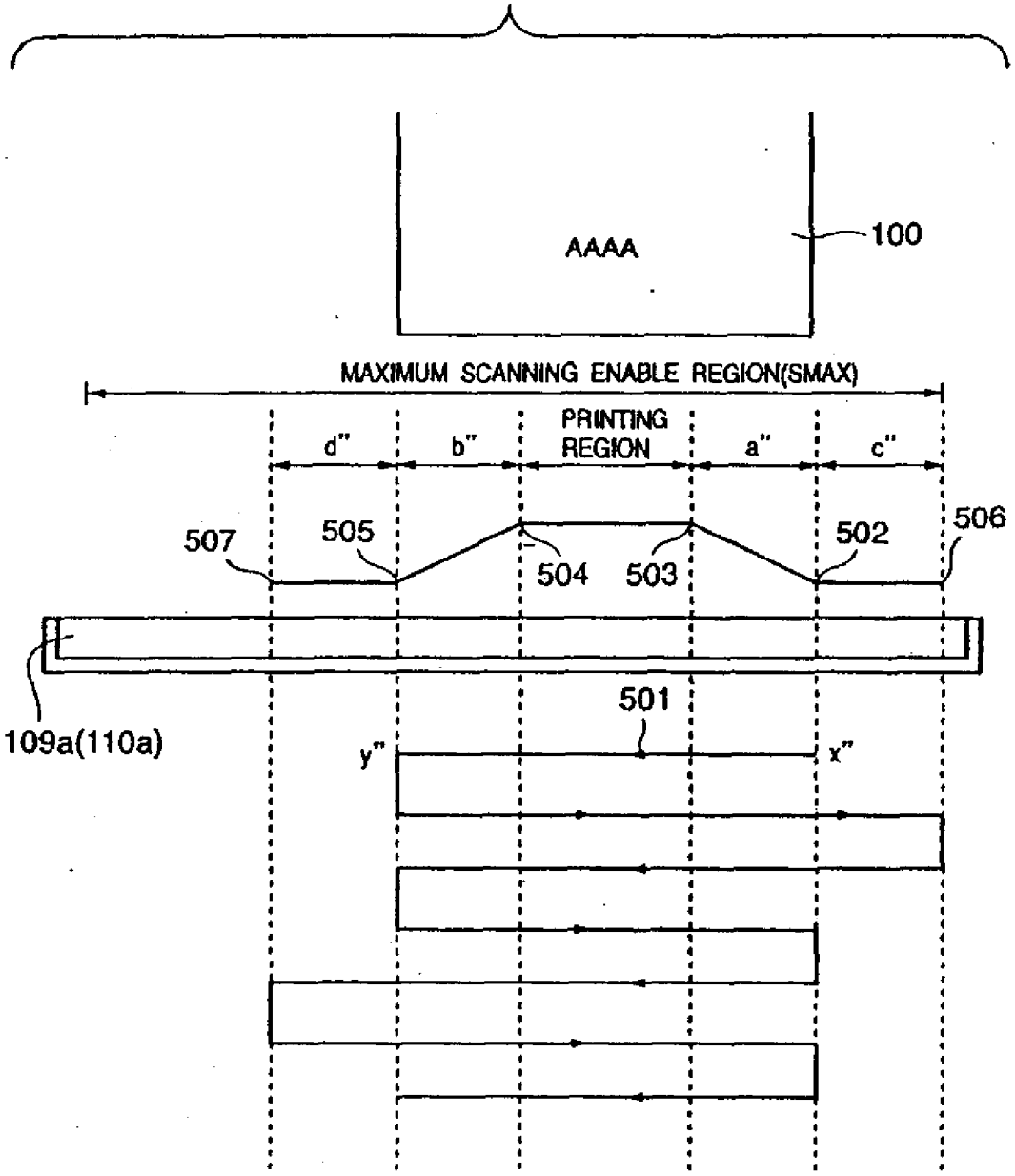
Figure 5:
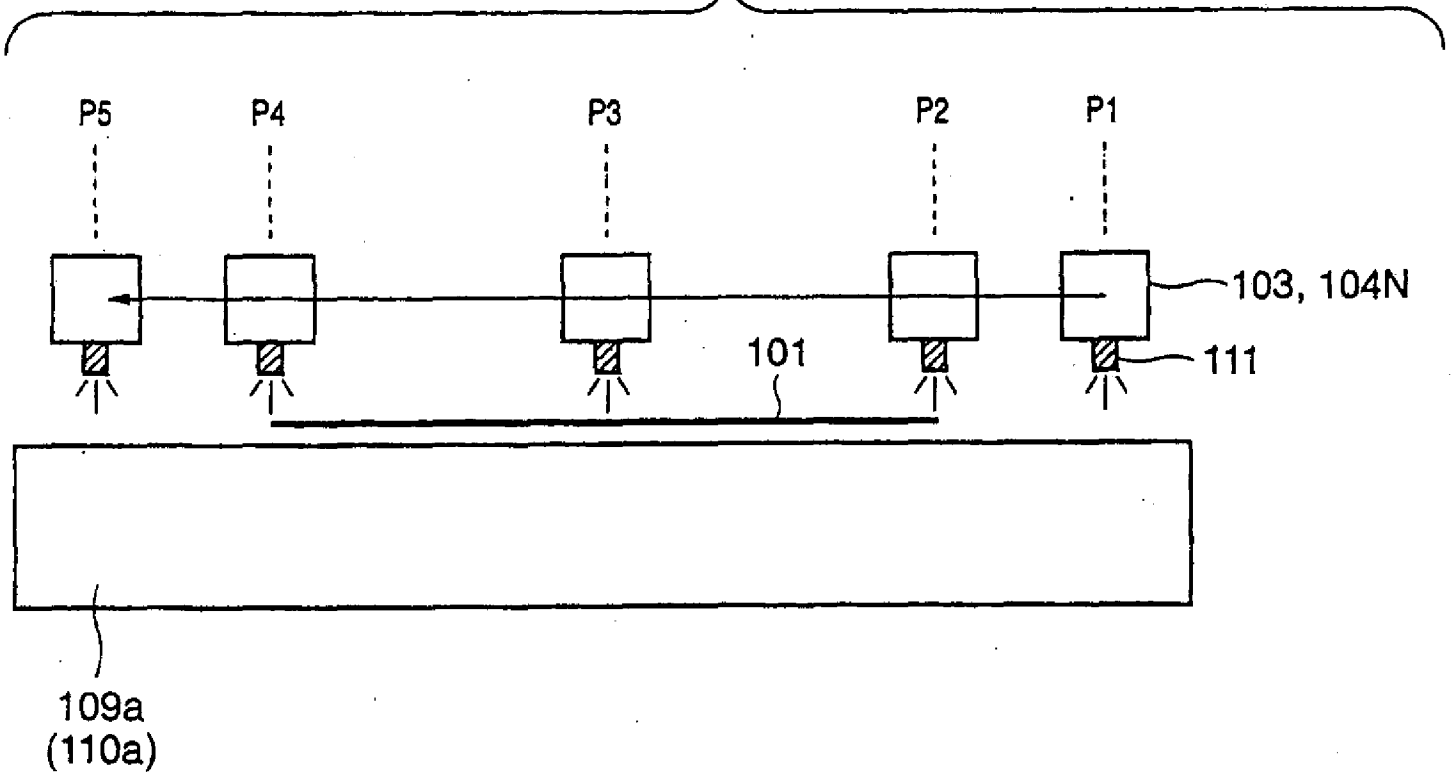
Figure 6:
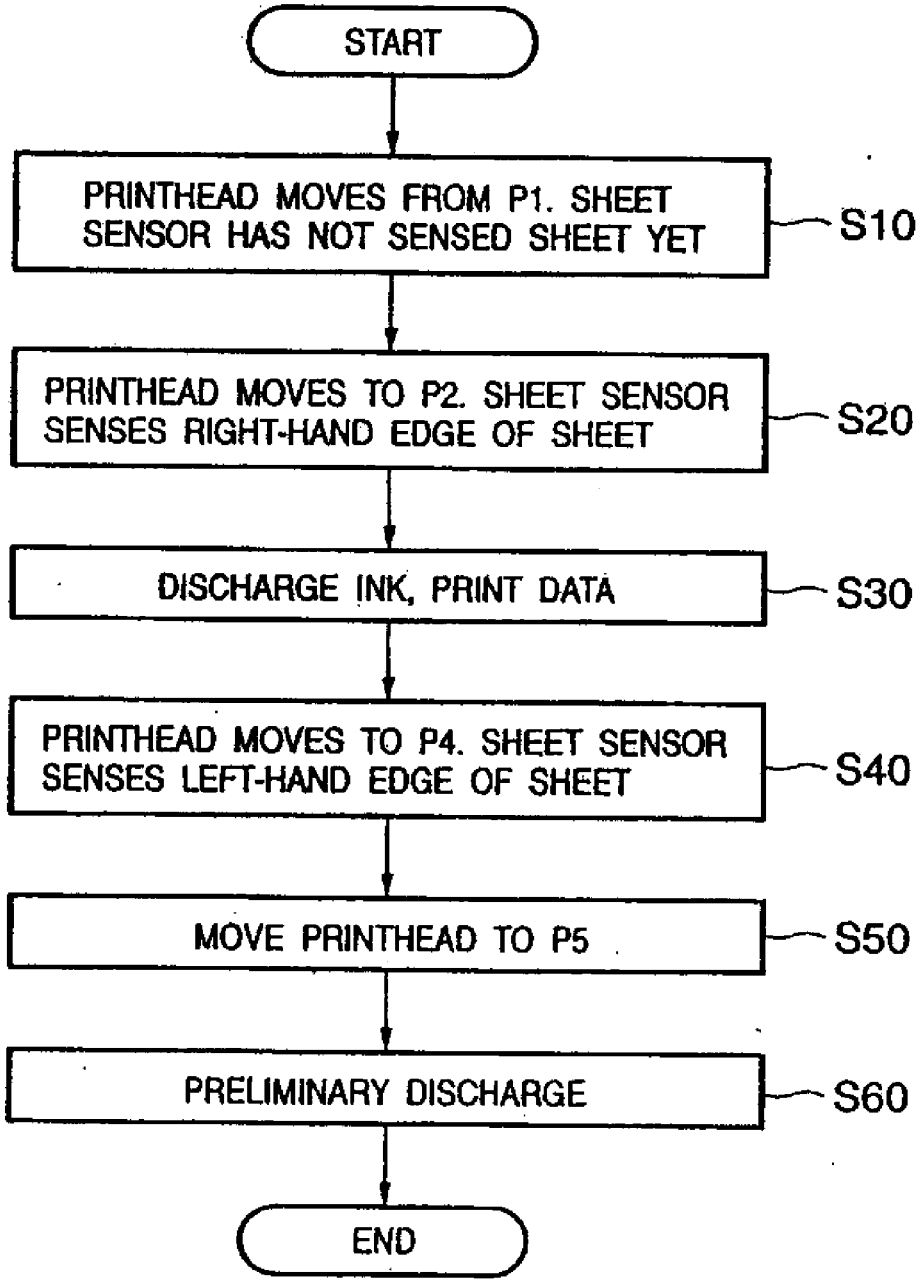
Figure 7:
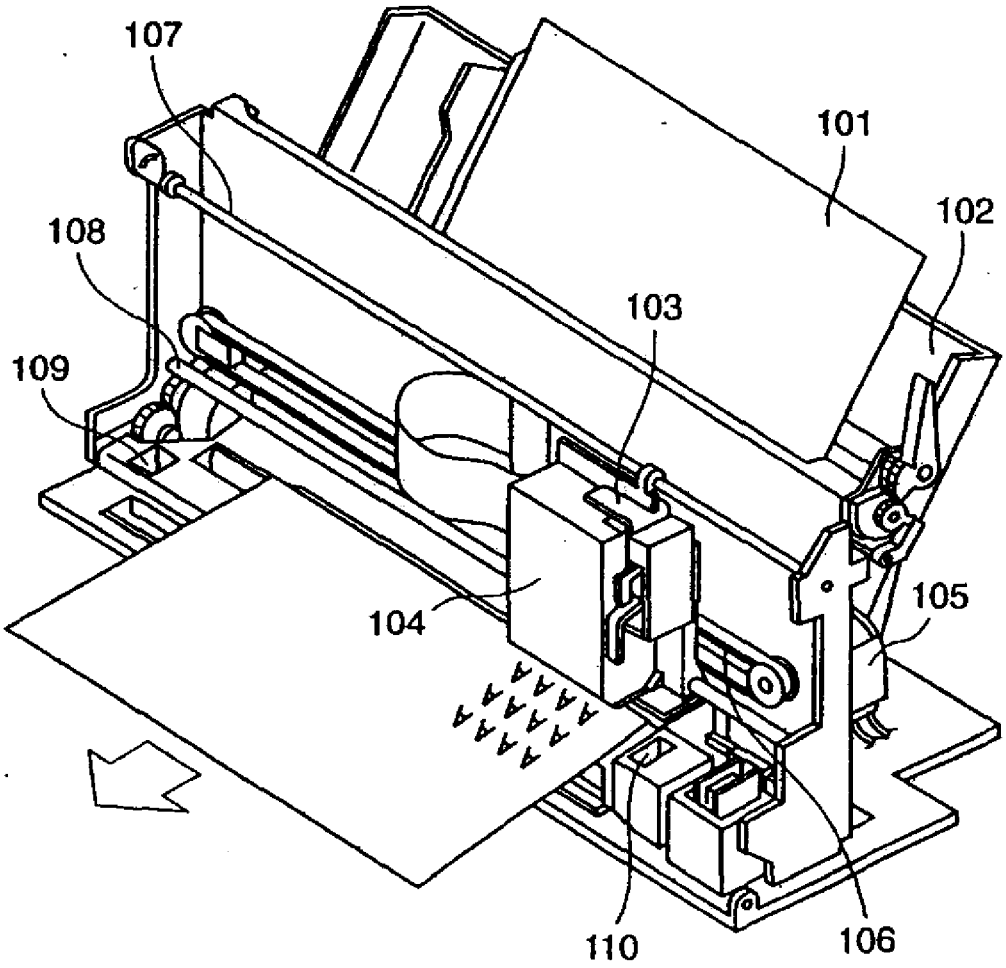
Figure 8:
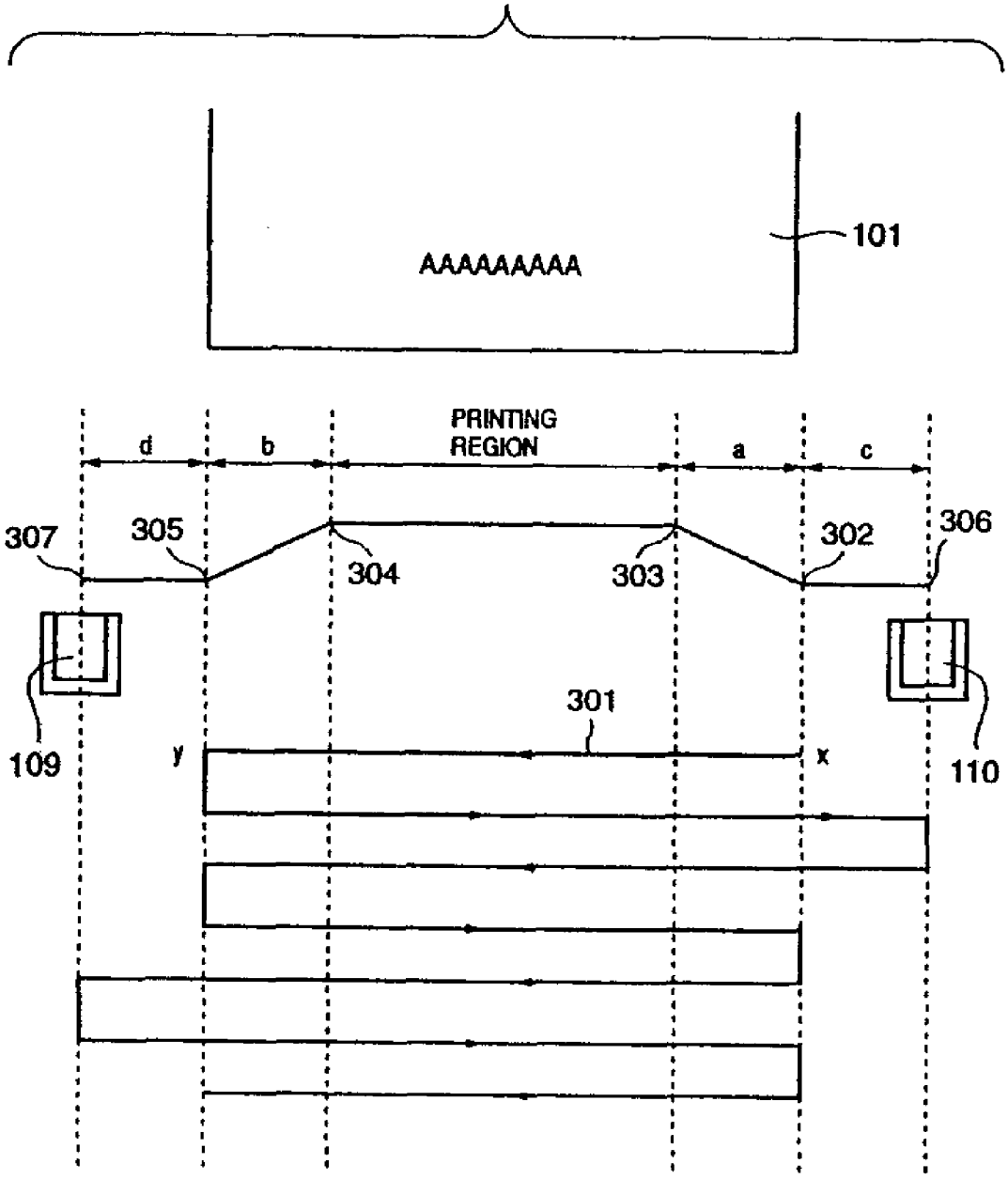
Figure 9:
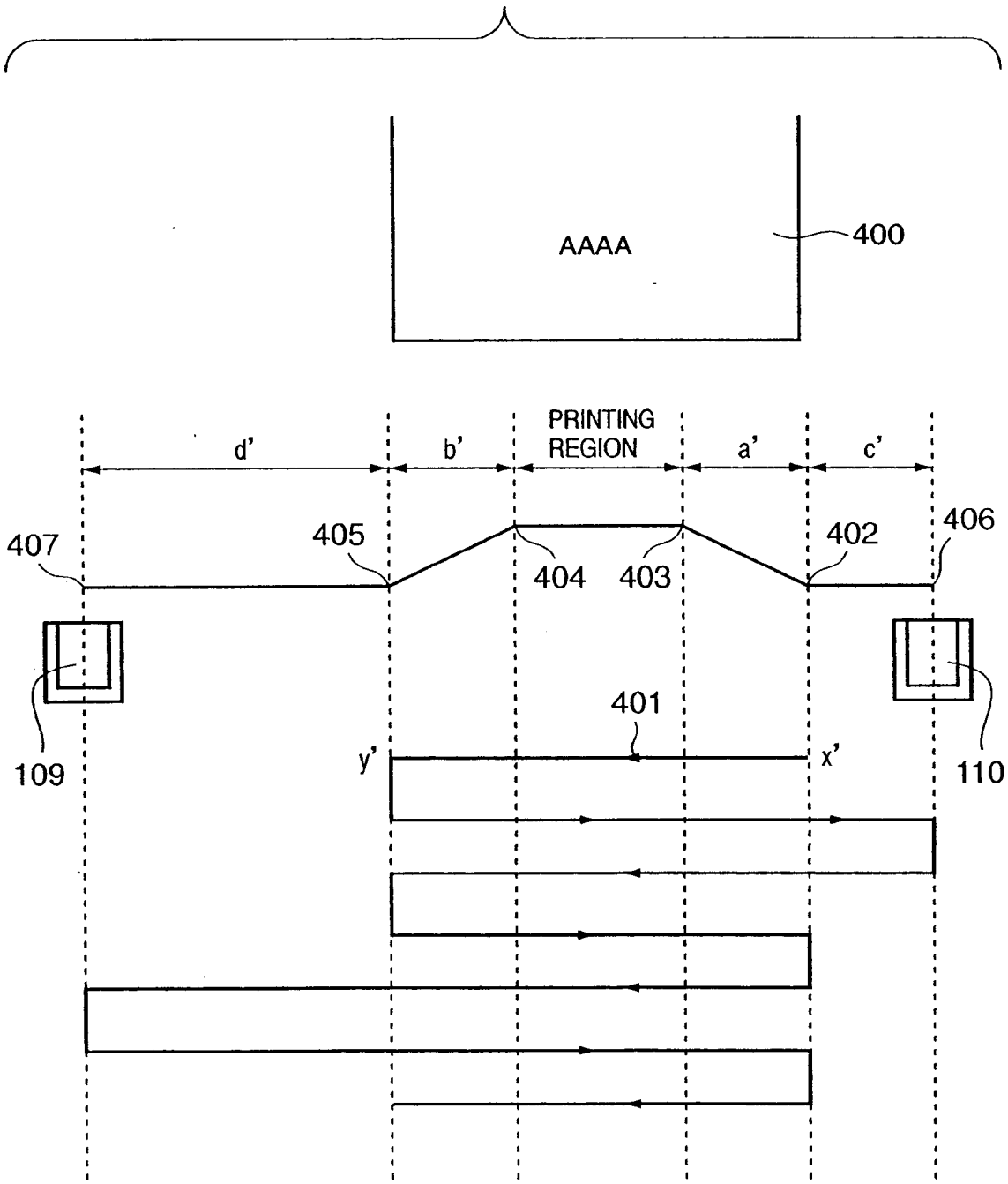

As can be seen by comparing the moving region d" to the position of preliminary discharge shown in FIG. 4 with the moving region d' to the position of preliminary discharge shown in FIG. 9 of the prior art, the moving region d" is shorter than the moving distance d'. This shortens the time necessary for the carriage movement required to execute a preliminary discharge operation during printing. Consequently, the time to the completion of printing can be further shortened.

The control of a preliminary discharge operation using a preliminary discharge receptor having a width covering the entire scanning region of the carriage 103 explained above will be described below with reference to FIGS. 5 and 6.

Figure 5:
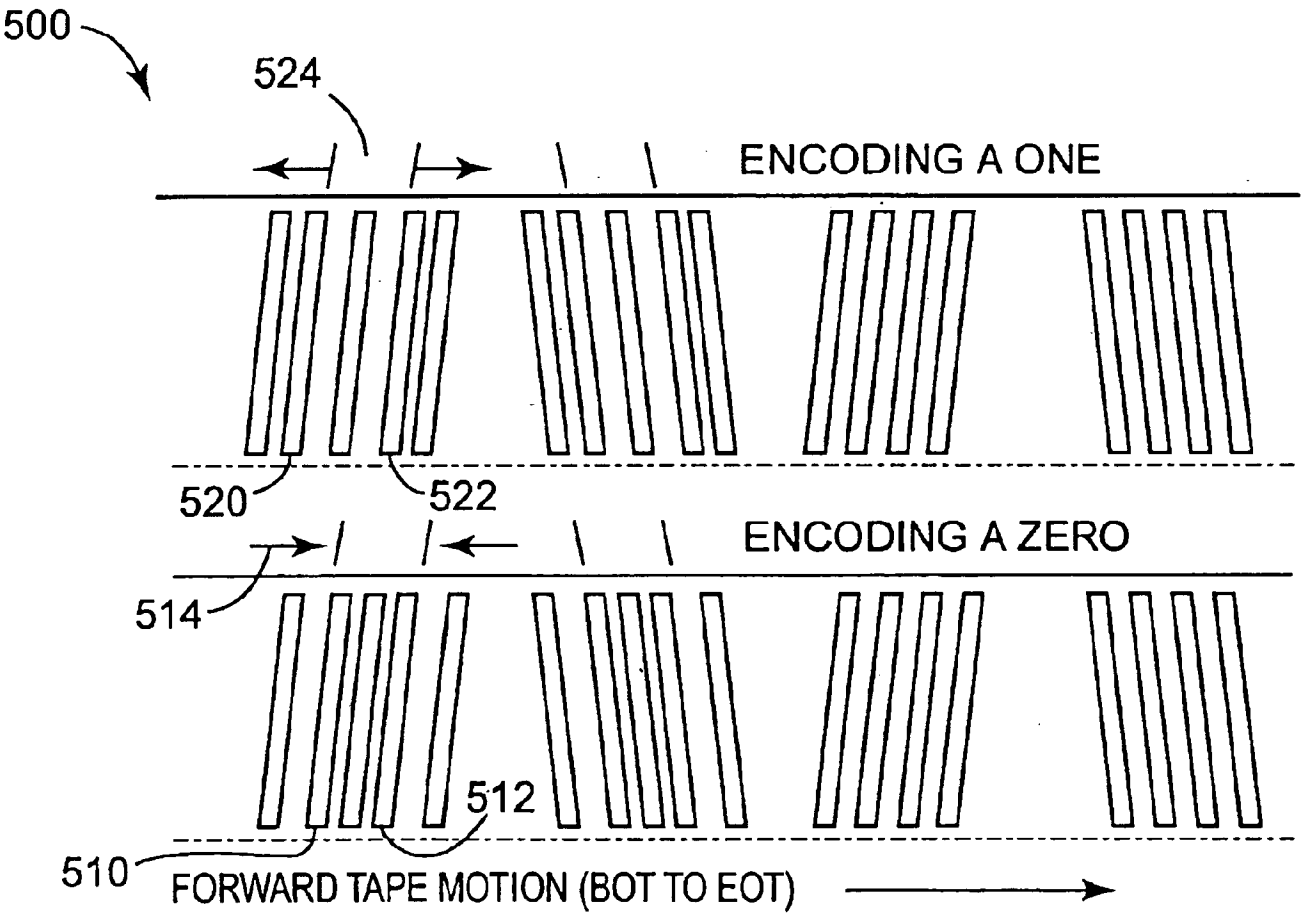
FIG. 5 is a schematic view showing an operation of sensing the right- and left-hand edges of a printing sheet by using a sheet sensor.

FIG. 5 is a view showing how to sense the coordinates of the right- and left-hand edges of a printing sheet in order to move the printhead to a preliminary discharge position by using the sheet sensor 111.

Figure 6:
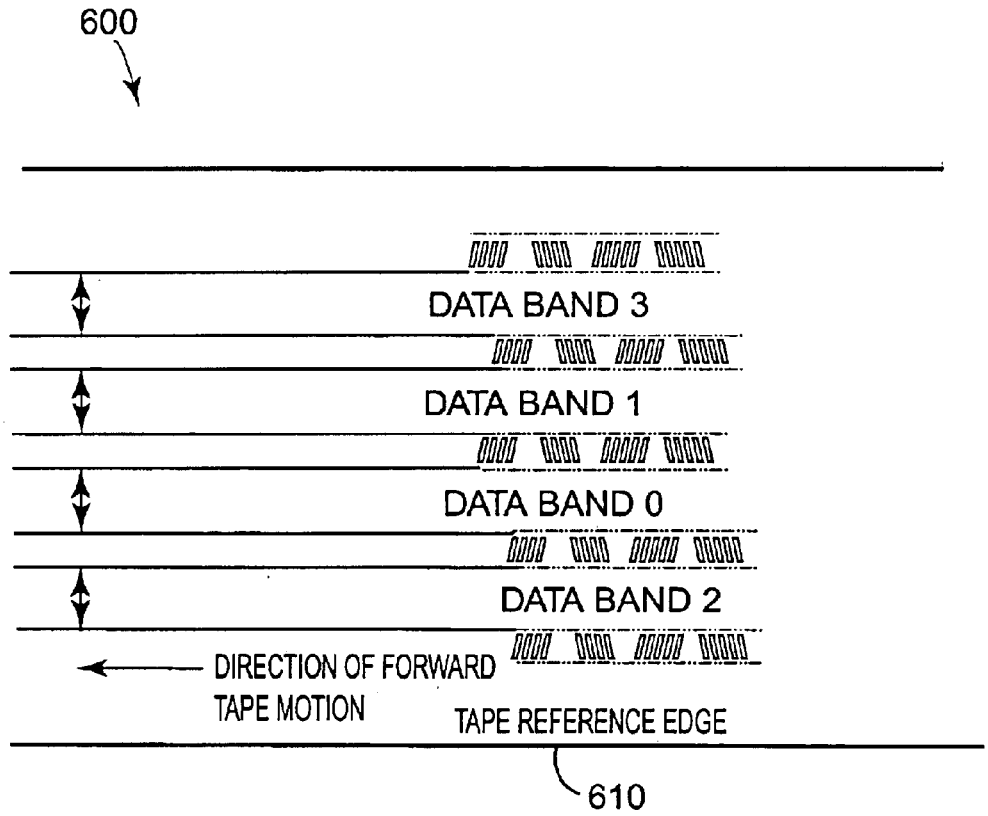
FIG. 6 is a flow chart showing the control of a preliminary discharge operation.

FIG. 6 is a flow chart showing the control of a preliminary discharge operation.

This flow chart explains control when the printhead 104N prints data by discharging ink while moving in the direction of an arrow shown in FIG. 5 and, after that, preliminary discharge is performed at the left-hand edge of scanning.

First, in step S10, the carriage 103 mounting the printhead 104N starts moving in the direction of the arrow from a point P1 shown in FIG. 5. At this time, the sheet sensor 111 has not sensed the printing sheet 101 yet.

Next, in step S20, the sheet sensor 111 senses the printing sheet 101 when the carriage 103 mounting the printhead 104N moves to the left in FIG. 5 to reach a position P2. Since the sheet absent state changes to the sheet present state, it is determined that the position P2 is the right-hand edge of the printing sheet 101. After that, in step S30 the printhead 104N discharges ink to print data. Although the printhead 104N further moves to the left in FIG. 5 during this printing, the sheet sensor 111 keeps sensing the presence of the printing sheet 101. This state of sensing continues until the carriage 103 mounting the printhead 104N reaches a position P4 from the position P2 via a position P3.

In step S40, the sheet sensor 111 can no longer sense the printing sheet 101 when the carriage 103 mounting the printhead 104N has reached the position P4. Since the sensor status changes from the sheet present state to the sheet absent state, it is determined that the position P4 is the left-hand edge of the printing sheet 101. The coordinates of this point P4 are stored in the DRAM 1703.

A preliminary discharge operation is started from this point. That is, in step S50, the carriage 103 mounting the printhead 104N is further moved to the left in FIG. 5 to a position P5, so that preliminarily discharged ink droplets do not stick to the printing sheet. At the positions P4 and P5, the sheet sensor 111 cannot sense any sheet because the printing sheet 101 does not exist below the sensor any longer. Note that the distance between these positions P4 and P5 corresponds to the moving region d" shown in FIG. 4.

In step S60, the printhead 101N performs preliminary discharge at the position P5.

In the above explanation, preliminary discharge is performed after the printhead 104N has printed data by moving in the direction of the arrow shown in FIG. 5. However, similar control is performed even when preliminary discharge is performed after the printhead has printed data by moving in the opposite direction. In this case, the coordinates of the position P2 are stored in the DRAM 1703, and preliminary discharge is performed at a point (e.g., the position P1) separated a predetermined distance from the position P2.

Also, the coordinate system for specifying the position of the printhead is a one-dimensional coordinate system which extends along the carriage moving direction and has a predetermined position (e.g., the home position of the carriage) as its origin.

In the above-mentioned embodiment, therefore, on the basis of the coordinates of the right- and left-hand edges of a printing sheet sensed by the sheet sensor, the printhead is separated from the printing sheet, i.e., from the sensed coordinates, by a distance necessary for preliminary discharge, and then preliminary discharge is performed. Accordingly, even when the width or position of the printing sheet changes, a preliminary discharge operation can be executed in an optimum position. This can minimize the carriage movement required for the preliminary discharge operation.

Consequently, the printing time can be minimized.

Furthermore, the printing sheet sensor attached to the carriage senses an actual printing sheet width, and the sensed coordinate position is stored. This makes it possible to accurately control the moving distance from the printing sheet edge to the preliminary discharge operation execution position. Hence, more accurate control by which the scanning region of the printhead is minimized can be performed.

In the above embodiment, a preliminary discharge position is separated a predetermined distance from the edge of a printing sheet. However, the present invention is not limited to this embodiment. For example, preliminary discharge can also be performed while the printhead is scanned farther from this position separated by the predetermined distance. Alternatively, preliminary discharge can be performed before or after the scanning directions of the printhead are switched in a position farther from the position separated by the predetermined distance. When this is the case, ink can be dispersed without being concentrated to a predetermined position of the ink receptor for receiving preliminary discharge.

The above designated predetermined distance can also be changed in accordance with the printing conditions. For example, the higher the discharge frequency of preliminary discharge, the further the ink scatters to the surroundings. Therefore, in this case it is possible to designate a longer distance from the edge of a printing sheet than when the discharge frequency is relatively low.

Furthermore, in the above embodiment, the preliminary discharge receptor having a width covering the entire scanning region of the carriage is taken as an example. However, the present invention is not restricted to this embodiment. For example, if printing sheets of several fixed forms (e.g., A3, A4, B4, and B5 sheets) are used as printing sheets, a preliminary discharge receptor need not have a width covering the whole scanning region. That is, it is possible to form a plurality of preliminary discharge receptors corresponding to positions separated a predetermined distance from the edges of these fixed-form sheets.

As many apparently widely different embodiments of the present invention can be made without departing from the spirit and scope thereof, it is to be understood that the invention is not limited to the specific embodiments thereof except as defined in the appended claims.

What is claimed is:

1. An inkjet printing apparatus for printing on a printing medium by discharging ink, on the basis of printing data, from a printhead detachably mounted on a carriage which moves back and forth on the printing medium, comprising:

control means for controlling said printhead to perform preliminary discharge, by which no printing is performed, between scanning actions of said carriage; and position changing means for changing a position at which the preliminary discharge is controlled by said control means to be performed by said printhead, wherein said position changing means changes the position at which the preliminary discharge is to be performed, in accordance with information regarding a position of an edge of the printing medium.

2. The apparatus according to claim 1, wherein the printing is performed by forward and backward scans of said printhead.

3. The apparatus according to claim 1, further comprising an ink receptor for receiving ink discharged by the preliminary discharge controlled by said control means, said ink receptor having a length not less than the length of a scanning range of said printhead.

4. The apparatus according to claim 1, further comprising a plurality of ink receptors for receiving ink discharged by the preliminary discharge controlled by said control means, in accordance with the width of the printing medium in the scanning direction.

5. The apparatus according to claim 1, further comprising sensing means for sensing the edge of the printing medium.

6. The apparatus according to claim 5, wherein said position changing means changes the preliminary discharge position in accordance with the information regarding the edge of the printing medium sensed by said sensing means after printing is performed.

7. The apparatus according to claim 5, further comprising storage means which, when the preliminary discharge is to be performed after said printhead performs printing in a first direction of forward and backward scans of said printhead, stores the information regarding the edge of the printing medium sensed by said sensing means after the printing is completed, and, when preliminary discharge is to be performed after said printhead performs printing in a second direction opposite to the first direction, stores the information regarding the edge of the printing medium sensed by said sensing means after the printing is completed.

8. The apparatus according to claim 1, wherein said position changing means changes the preliminary discharge position such that the preliminary discharge is performed at a position separated a predetermined distance from the position of the edge of the printing medium, regardless of the edge position of the printing medium.

9. The apparatus according to claim 8, wherein the predetermined distance when the ink discharge frequency of printing is relatively high is made longer than that when the ink discharge frequency is relatively low.

10. The apparatus according to claim 1, wherein when performing preliminary discharge after printing in a forward or backward scanning direction, said control means so controls said printhead as to move in the forward or backward scanning direction, after the printing is completed, and to perform a preliminary discharge operation.

11. The apparatus according to claim 1, wherein said control means so controls said printhead as to perform the preliminary discharge, while said printhead is scanning, in a position farther from the printing medium than the position changed by said position changing means.

12. The apparatus according to claim 11, wherein said control means so controls said printhead as to perform the preliminary discharge before or after scanning directions are switched.

13. The apparatus according to claim 1, wherein said printhead is an inkjet print head for discharging ink by using thermal energy, and comprises an electrothermal converter for generating the thermal energy to be applied to ink.

14. The apparatus according to claim 1, wherein the change of the position is performed according to information regarding a width of the printing medium with respect to a scanning direction of the carriage.

15. A preliminary discharge control method used in an inkjet printing apparatus for printing on a printing medium by discharging ink, on the basis of printing data, from a printhead detachably mounted on a carriage which moves back and forth on the printing medium, comprising:

a position changing step of changing a position at which preliminary discharge, by which no printing is performed, is performed between scanning actions of the carriage; and a control step of controlling the printhead to perform the preliminary discharge, wherein said position changing step changes a position at which the preliminary discharge is to be performed, in accordance with information regarding a position of an edge of the printing medium.

16. The method according to claim 15, further comprising a sensing step of sensing the edge of the printing medium.

17. The method according to claim 16, wherein said position changing step comprises changing the preliminary discharge position in accordance with the information regarding the edge of the printing medium sensed in said sensing step after printing is performed.

18. The method according to claim 15, wherein said position changing step comprises changing the preliminary discharge position such that the preliminary discharge is performed at a position separated a predetermined distance from the position of the edge of the printing medium, regardless of the edge position of the printing medium.

19. The method according to claim 18, wherein the predetermined distance when the ink discharge frequency of printing is relatively high is made longer than that when the ink discharge frequency is relatively low.

20. The method according to claim 15, wherein when performing the preliminary discharge after printing in a forward or backward scanning direction, said control step comprises so controlling the printhead as to move in the forward or backward scanning direction, after the printing is completed, and to perform a preliminary discharge operation.

21. The method according to claim 15, wherein said control step comprises so controlling the printhead as to perform the preliminary discharge, while the printhead is scanning, in a position farther from the printing medium than the position changed in said position changing step.

22. The method according to claim 21, wherein said control step comprises so controlling the printhead as to perform the preliminary discharge before or after scanning directions are switched.

23. The method according to claim 15, wherein the change of the position is performed according to information regarding a width of the printing medium with respect to a scanning direction of the carriage.

* * * * *

UNITED STATES PATENT AND TRADEMARK OFFICE

CERTIFICATE OF CORRECTION

PATENT NO. : 6,761,430 B2
DATED : July 13, 2004
INVENTOR(S) : Kinoshita

It is certified that error appears in the above-identified patent and that said Letters Patent is hereby corrected as shown below:

Title page,
Below ABSTRACT, "23 Claims, 10 Drawing Sheets" should read -- 23 Claims, 9 Drawing Sheets --.
The drawing should be replaced with the following:

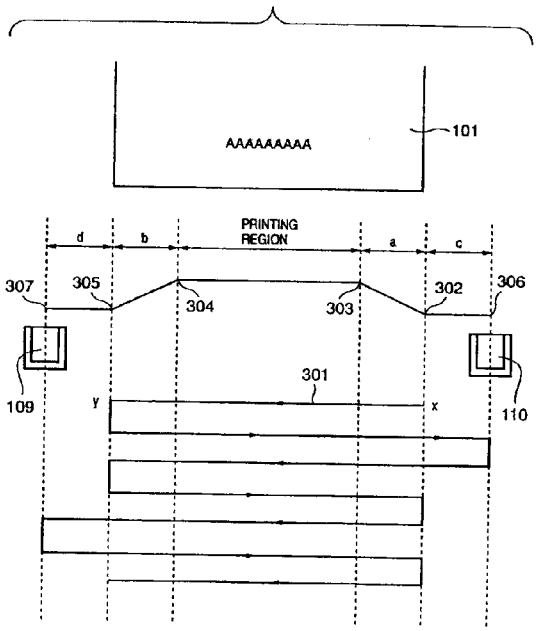

Signed and Sealed this

Twenty-third Day of August, 2005

JON W. DUDAS
*Director of the United States Patent and Trademark Office*